US005253463A

United States Patent [19]

Witmyer

[11] Patent Number: 5,253,463

[45] Date of Patent: Oct. 19, 1993

[54] SAFETY MECHANISM FOR A KERFED CEILING PANEL

[75] Inventor: Brian E. Witmyer, Lititz, Pa.

[73] Assignee: Armstrong World Industries, Inc., Lancaster, Pa.

[21] Appl. No.: 981,380

[22] Filed: Nov. 25, 1992

[51] Int. Cl.[5] ..... E06B 3/54

[52] U.S. Cl. ..... 52/484; 52/489

[58] Field of Search ..... 52/484, 489, 488, 39

[56] References Cited

U.S. PATENT DOCUMENTS

| | | | |
|---|---|---|---|
| 1,997,582 | 4/1935 | Heeren et al. | 52/489 X |
| 2,281,109 | 4/1942 | Olsen | 52/489 X |
| 3,029,755 | 4/1962 | Crichton | 52/484 X |
| 3,481,088 | 12/1969 | Lickliter et al. | 52/484 X |
| 3,716,956 | 2/1973 | Stanley | 52/488 X |
| 4,033,079 | 7/1977 | Cross | 52/99 |
| 4,279,110 | 7/1981 | Palazzolo et al. | 52/489 X |
| 4,438,613 | 3/1984 | Hintsa et al. | 52/489 X |
| 4,463,537 | 8/1984 | Rodriquez | 52/489 |
| 4,476,659 | 10/1984 | Player | 52/484 X |
| 5,024,034 | 6/1991 | Gailey | 52/484 |

FOREIGN PATENT DOCUMENTS

| | | | |
|---|---|---|---|
| 2578571 | 9/1986 | France | 52/489 |
| 602489 | 5/1948 | United Kingdom | 52/484 |
| 1001659 | 8/1965 | United Kingdom | 52/489 |

*Primary Examiner*—Peter M. Cuomo
*Assistant Examiner*—Jerry Redman

[57] ABSTRACT

The safety mechanism will act to provide a security device which will prevent a kerfed ceiling panel from falling to the floor if the panel is disengaged from the grid system due to improper installation, seismic event, or other reasons. The mechanism is designed to use a retractable hook structure which moves from an inactive position prior to installing the ceiling tile to an active position where the hooked mechanism will be able to engage the vertical web of the runner of the grid system to prevent a disengaged ceiling panel from falling out of the grid system to the floor of a room.

5 Claims, 1 Drawing Sheet

SAFETY MECHANISM FOR A KERFED CEILING PANEL

BACKGROUND OF THE INVENTION

1. Field of the Invention

This invention is directed to an improvement in a ceiling panel which is supported in a grid system, and particularly, a safety mechanism for preventing the ceiling panel, accidentally disengaged from the grid system, from falling to the floor.

2. Description of the Prior Art

The prior art has used ceiling panels with hook-like elements which engage the T-bar grid bulb of a ceiling runner. Normally, these structures hold the ceiling panel in position on the ceiling runner. The prior art does not appear to teach a safety mechanism consisting of a hook element, a pivot means and an activator flange being activated when the ceiling panel is placed in a suspended ceiling system. Placing the ceiling panel in position pivots the hook to its vertical position over the grid bulb so that disengagement of the ceiling panel from the flange of the runner will permit the hook to engage the grid runner bulb and retain the ceiling panel generally within the suspended ceiling system.

U.S. Pat. No. 4,033,079 shows a hold-down clip for ceiling panels which is attached to the edge of the panel and which includes a hook portion for engaging the bulb of the support grid.

U.S. Pat. Nos. 4,463,537 and 5,024,034 disclose suspension hooks for ceiling panels which engage the flanges rather than the bulb of a support runner.

U.S. Pat. No. 4,648,229 discloses a suspended ceiling system having tiles with interspersed hooks resting on runners. The hooks from adjacent ceiling panels rest on the top of the same runners but not upon each other.

SUMMARY OF THE INVENTION

The invention is a safety mechanism for a kerfed ceiling panel wherein the ceiling panel has a front face, four sides and a back with the back having at least a partially open area. Two opposite sides each of the ceiling panel have kerf grooves extending along the length of each side. The improvement is the use of at least one hook-shaped element positioned on each of the opposed sides. Each hook element has a J-shaped one end, a mid-region pivot point and an activator flange on the other end. Each hook structure is pivotally fastened to a side of the ceiling panel with a kerf. The activator flange is positioned in the kerf and the J-shaped end is positioned in the partly open area in the back of the ceiling panel. When a means such as the flange of a ceiling runner is inserted into the kerf, it moves the activator flange around the pivot point to move the J-shaped hook end to a position with the inverted J-shaped open end positioned over the region at or just beyond the edge of the ceiling panel. If a runner is used, the open end of the J-shape is positioned above the vertical web of the runner.

The ceiling panel particularly used is a metal pan type of ceiling panel which has its backside totally open and the hooks can readily be positioned within the back of the ceiling panel.

The invention includes the method of positioning the ceiling panel on grid runners to activate the hook structures to permit the hook structures to be held in their activated or second position. When the hook elements are in their first position, lying within the recessed area of the ceiling panel, it is quite possible to stack a series of ceiling panels upon each other without the hooks in anyway preventing a close stacking of the ceiling panels. When the ceiling panel is installed, the hooks are in position above the vertical web of a runner and if the ceiling panel should become disengaged where the flange of the ceiling runner is removed from the kerf of the ceiling panel, the ceiling panel will not drop to the floor but would drop just a short distance and the hook-shaped element would engage the web of the runner to hold the ceiling panel in position within the general framework of the suspended ceiling system.

DESCRIPTION OF THE PREFERRED EMBODIMENT

Figure 1:
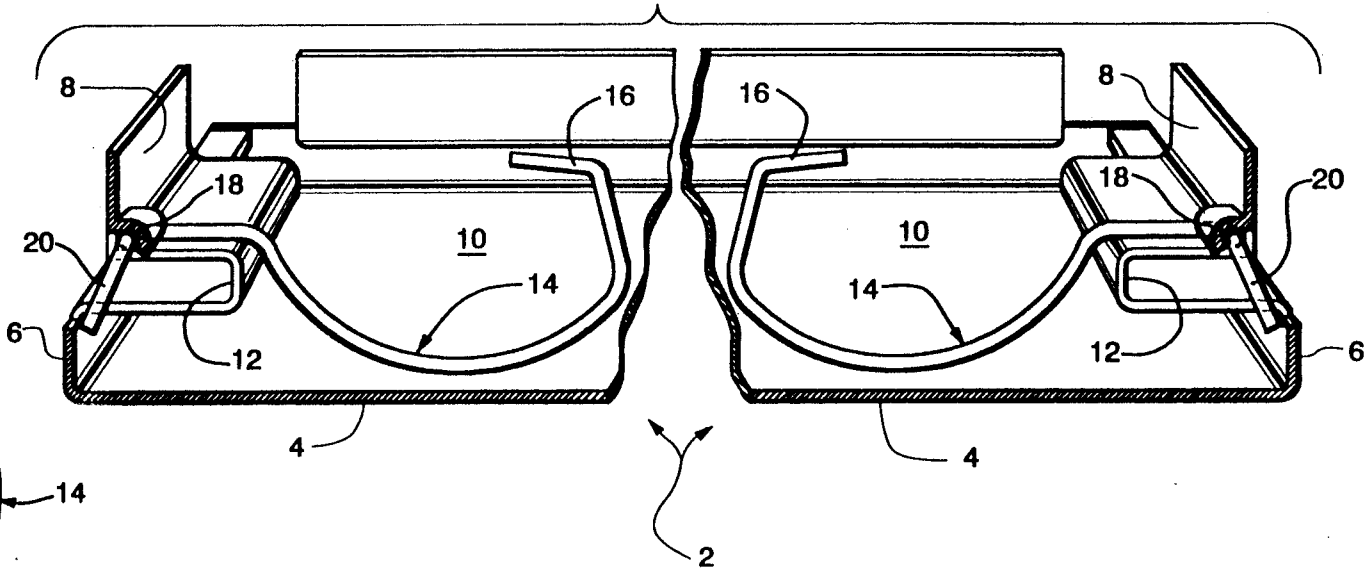
FIG. 1 is a perspective view of the ceiling panel showing the placement of the hook-shaped elements within the open area in the back of the ceiling panel.
Figure 2:
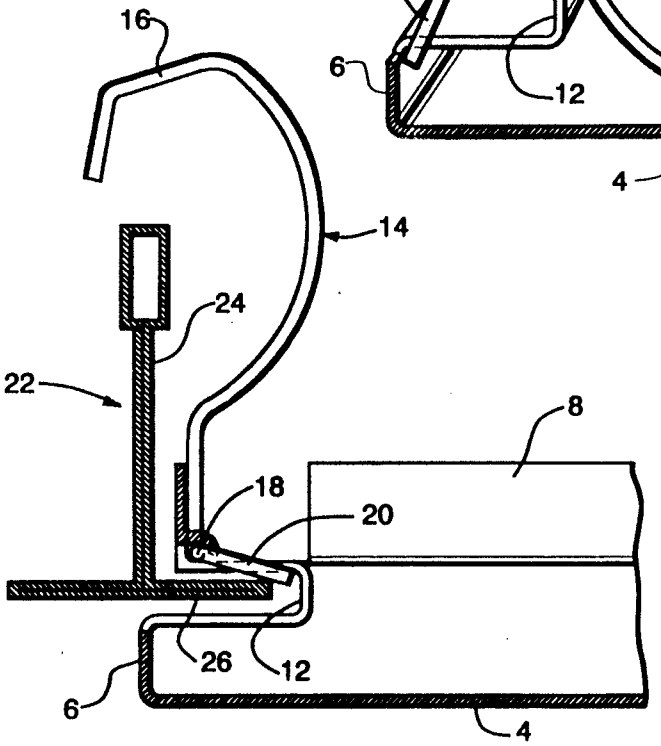
FIG. 2 is a partial side view of the ceiling panel mounted on a grid runner with the hook-shaped element in its activated position above the vertical web of the ceiling runner.

The invention herein is a safety mechanism for a kerfed ceiling panel. The ceiling panel 2 has a flat face 4, four sides 6 and a back 8 with at least a partially open area 10. Two opposite sides of the ceiling panel, as shown in FIG. 1 being the right side and the left side shown in the figure, each have a kerf groove 12 extending along the length of each side. This ceiling panel is a commercially available ceiling panel. The improvement herein is the provision of at least one hook-shaped element 14 positioned on only one side with a kerf groove on each of the opposite sides with each hook having a J-shaped one end 16, a mid-region pivot point 18 and an activator flange 20 on the other end. Each hook-shaped element is pivotally fastened to a side of the ceiling panel with a kerf. The activator flange is positioned in the kerf and the J-shaped end is positioned in the partially open area 10 in the back of the ceiling panel. This defines a first position for the hook-shaped element. For shipping, the hook will lie horizontal in the back of the panel while the activator flange will not block the kerf. This will permit compact packing of the ceiling panels in a shipping carton. The pivot point for the hook-shaped element is connected in a socket at the top edge of the kerf-side of the panel, thus permitting the hook and activator flange to pivot. It is recommended that two hook-shaped elements be provided per ceiling panel, one on each kerf, preferably mounted off center.

The ceiling panel as shown is a metal pan with the open area forming, in effect, the back of the ceiling tile. Since the product is made from sheet metal, the sheet metal forms the face and the four sides and the back of the ceiling panel is open. The activator flange is at an approximate right angle to the J-shaped end with the pivot means being located at the apex of the right angle. The hook-shaped element is positioned within the ceiling panel so that the activator flange may be engaged by the flange of a ceiling runner 22 inserted into the kerf of the ceiling panel. Movement of the activating flange moves the hook-shaped element from its first position to a second position with the open end of the hook-shaped element above the web 24 of the runner 22. Now should improper installation, a seismic event or some other reason cause the flange 26 of the ceiling runner 22 to become disengaged from the kerf 12 of the ceiling panel, permitting the ceiling panel to drop away from the flange 26, the hook-shaped element 16 will engage the upper end of the runner and prevent the ceiling panel from dropping out of the suspension system for the ceiling panel.

The method of positioning the ceiling panel on the ceiling runner would involve the inserting of first one kerfed edge on one ceiling runner and this would engage one of the hooked shaped elements. A ceiling panel is pushed as far as possible towards the runner so the flange extends as far as possible into the kerf. This will make the opposite edge of the ceiling panel in a position so that the upper end of the panel will swing pass the flange of an adjacent ceiling runner and permit the panel then to be moved in the direction of the second ceiling runner to engage the second hooked structure and hold the ceiling panel in position with both kerfs having the adjacent ceiling runner flanges engaged in the kerfs. Appropriate means may hold the ceiling panel positioned on both flanges by having some type of resilient means resisting accidental movement of the ceiling panel towards the first runner which would then permit the flange of the second runner to disengage from the kerf. Such a feature is known in the art.

Both hooked structures are positioned with their open ends above the runner vertical web as a safety mechanism.

What is claimed is:

1. A safety mechanism for a kerfed ceiling panel comprising:

(a) a ceiling panel having a front face, four sides and a back with at least a partially open area, two opposed sides each having a kerf extending along the length of the side;

(b) the improvement being at least one hook shaped element positioned on at least one of the opposed sides, said hook shaped element having a J-shaped open end, a mid-region pivot point and activator flange on the other end;

(c) said hook being pivotally fastened to a side of the coiling panel with a kerf, the activator flange being positioned in the kerf and the J-shaped open end being positioned in the partially open area in the back of the ceiling panel in a first position; and (d) means inserted in the kerf moving the activator flange around the pivot point to move the J-shaped end to a second position with the inverted J-shaped open end positioned above and over and just beyond the side of the coiling panel.

2. The safety mechanism of claim 1 wherein:

(a) the coiling panel is a metal pan with the open area being formed of the four sides and the front face, and said hook-shaped element in its first position is within the back of the metal pan; and (b) the activator flange is at an approximate right angle to the J-shaped end with the pivot means being located at the apex of the right angle.

3. The safety mechanism of claim 2 wherein:

(a) one side of the ceiling panel with said hook-shaped element is used with a ceiling runner having a vertical web with a lower end and a flange at a right angle ,at the lower end of the vertical web; and (b) the insertion of the flange into the kerf moves the hook-shaped element its first position to its second position with the J-shaped open end of the hook-shaped element above the web of the runner.

4. The safety mechanism of claim 3 wherein:

(a) there is one hook-shaped element on each of the opposed sides.

5. The method of positioning a ceiling panel with a partially open area in the back side thereof on at least one coiling runner, said ceiling runner having a vertical web and a horizontal flange, said ceiling panel having an edge with a kerf groove extending along the length of the edge, a hook-shaped element positioned on the edge having the kerf, each hook-shaped element having a J-shaped open end, a mid-region pivot point, an activator flange on the other end, the hook-shaped element being pivotally fastened to a side of the coiling panel adjacent the kerf, the activator flange being positioned in the kerf and the J-shaped open end being positioned in the partially open area in the back of the coiling panel in a first position, the step of inserting the flange of the grid runner into the kerf groove to engage the activator flange and to cause the activator flange to move around the pivot point to move the J-shaped end to a second position, the second position will place the J-shaped end of the hook-shaped element above or just beyond the edge of the coiling panel with the J-shaped open end of the hook-shaped element positioned above and over the vertical web of the coiling runner.

* * * * *